United States Patent [19]

Nakajima

[11] Patent Number: 4,807,289

[45] Date of Patent: Feb. 21, 1989

[54] APPARATUS FOR RECORDING AND REPRODUCING HUMAN SPEECH BY ITS ANALYSIS AND SYNTHESIS

[75] Inventor: Takao Nakajima, Yokohama, Japan

[73] Assignee: Kabushiki Kaisha Toshiba, Kawasaki, Japan

[21] Appl. No.: 780,883

[22] Filed: Sep. 27, 1985

[30] Foreign Application Priority Data

Sep. 28, 1984 [JP] Japan ..... 59-203255

[51] Int. Cl.[4] ..... G10L 5/00

[52] U.S. Cl. ..... 381/36; 364/513.5; 365/222

[58] Field of Search ..... 381/36, 43, 51; 364/513.5; 365/222

[56] References Cited

U.S. PATENT DOCUMENTS

| | | | |
|---|---|---|---|
| 4,203,005 | 5/1980 | Fukuda et al. | 381/36 X |
| 4,628,488 | 12/1986 | Saku et al. | 365/222 |
| 4,636,989 | 1/1987 | Ikuzaki | 365/222 |
| 4,675,840 | 6/1987 | Raymond et al. | 364/513.5 |
| 4,677,592 | 6/1987 | Sakurai et al. | 365/222 |

OTHER PUBLICATIONS

"Speech Synthesis LSIs", *Toshiba Electron Device News,* vol. 1, No. 2, pp. 18–21, 1984.

*Primary Examiner*—Patrick R. Salce
*Assistant Examiner*—Marc S. Hoff
*Attorney, Agent, or Firm*—Foley & Lardner, Schwartz, Jeffery, Schwaab, Mack, Blumenthal & Evans

[57] ABSTRACT

A speech analysis and synthesis device comprises analyzing and synthesizing means for analyzing human speech to produce analyzed data and for synthesizing human speech on the basis of the analyzed data, a dynamic RAM for memorizing the analyzed data, a refresh address counter for outputting a refresh address sequentially varying every a predetermined refresh cycle for designating a memory location of the dynamic RAM, an access address counter for outputting an access address indicative of a memory location where the analyzed data is accessed, and refresh-access means for effecting a refresh operation of a memory cell assigned to the refresh address every the predetermined refresh cycle and for providing an access to a memory cell assigned to the access address in synchronism with the predetermined refresh cycle during non-refresh cycle. The speech analysis and synthesis device enables connection of the dynamic RAM without provision of complicated peripheral circuits.

2 Claims, 3 Drawing Sheets

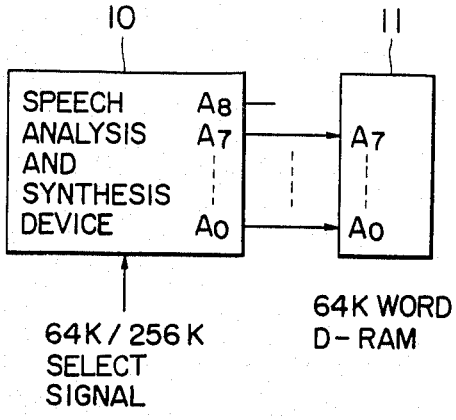

FIG. 5(a)

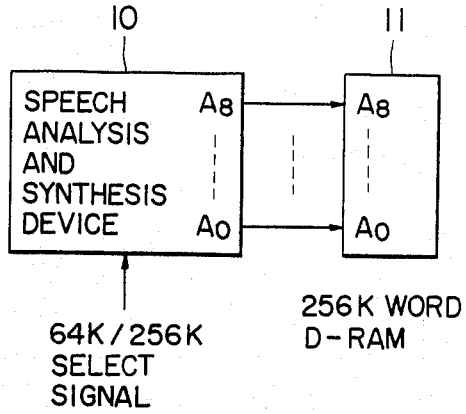

FIG. 5(b)

| | OUTPUT OF SWITCHING CIRCUIT 12 | | | | | | | | |
|---|---|---|---|---|---|---|---|---|---|
| | $A_8$ | $A_7$ | $A_6$ | $A_5$ | $A_4$ | $A_3$ | $A_2$ | $A_1$ | $A_0$ |
| OUTPUT OF REFRESH ADDRESS COUNTER 13 | X | X | $RF_6$ | $RF_5$ | $RF_4$ | $RF_3$ | $RF_2$ | $RF_1$ | $RF_0$ |
| OUTPUT OF ADDRESS MULTIPLEXER 14 | X | $AD_7$ | $AD_6$ | $AD_5$ | $AD_4$ | $AD_3$ | $AD_2$ | $AD_1$ | $AD_0$ |
| | X | $AD_{15}$ | $AD_{14}$ | $AD_{13}$ | $AD_{12}$ | $AD_{11}$ | $AD_{10}$ | $AD_9$ | $AD_8$ |

FIG. 6(a) WHEN 64K WORD D-RAM IS USED X: DON'T CARE

| | OUTPUT OF SWITCHING CIRCUIT 12 | | | | | | | | |
|---|---|---|---|---|---|---|---|---|---|
| | $A_8$ | $A_7$ | $A_6$ | $A_5$ | $A_4$ | $A_3$ | $A_2$ | $A_1$ | $A_0$ |
| OUTPUT OF REFRESH ADDRESS COUNTER 13 | X | $RF_7$ | $RF_6$ | $RF_5$ | $RF_4$ | $RF_3$ | $RF_2$ | $RF_1$ | $RF_0$ |
| OUTPUT OF ADDRESS MULTIPLEXER 14 | $AD_8$ | $AD_7$ | $AD_6$ | $AD_5$ | $AD_4$ | $AD_3$ | $AD_2$ | $AD_1$ | $AD_0$ |
| | $AD_{17}$ | $AD_{16}$ | $AD_{15}$ | $AD_{14}$ | $AD_{13}$ | $AD_{12}$ | $AD_{11}$ | $AD_{10}$ | $AD_9$ |

FIG. 6(b) WHEN 64K WORD D-RAM IS USED X: DON'T CARE

APPARATUS FOR RECORDING AND REPRODUCING HUMAN SPEECH BY ITS ANALYSIS AND SYNTHESIS

BACKGROUND OF THE INVENTION

The present invention relates to an apparatus for analyzing and synthesizing human speech.

An apparatus for analyzing and synthesizing human speech requires a large capacity of storage for memorising analyzed data of human speech. In addition, storages used for this purpose must be accessible at a high speed for realizing real time processing of human speech. Hitherto, there have been used static RAMs whose peripheral circuits are easily configured. However, when a time length of human speech to be analyzed and synthesized is increased, the capacity of storage required therefor is dramatically increased. Because of high cost of the static RAM, when the storage capacity is increased, the cost of the static RAM will raise the cost of the apparatus for analyzing and synthesizing human speech.

On the other hand, since dynamic RAMs are inexpensive as compared with static RAMs, they are suitable for use in analyzing and synthesizing human speech when high speed and large capacity storages are needed. However, with dynamic RAMs, refresh operation is always required. In addition, the apparatus for analyzing and synthesizing human speech requires real time operation. It is necessary to analyze and synthesize human speech even during refresh cycle. Accordingly, it is required to provide a peripheral circuit which effects complicated timing control in order to use dynamic RAMs in an apparatus for analyzing and synthesizing human speech.

SUMMARY OF THE INVENTION

An object of the present invention is to provide an apparatus for analyzing and synthesizing human speech to which a dynamic RAM is connectable without adding a complicated peripheral circuit.

To achieve this object, there is provided an apparatus for analyzing and synthesizing human speech comprising: means for analyzing human speech to produce analyzed data and for synthesizing human speech on the basis of said analyzed data; a dynamic RAM for memorizing said analyzed data; a refresh address counter for outputting a refresh address sequentially varying every predetermined refresh cycle, said refresh address indicating a location of a memory cell to be refreshed in said dynamic RAM; an access address counter for outputting an access address indicative of a location of a memory cell where said analyzed data in said dynamic RAM is accessed; and means for effecting a refresh operation of a memory cell assigned to said refresh address every said predetermined refresh cycle and for providing an access to a memory cell assigned to said access address in synchronism with said predetermined refresh cycle for a time period during which a refresh operation is not effected.

BRIEF DESCRIPTION OF THE DRAWINGS

In the accompanying drawings:

FIG. 5 is a block diagram illustrating a further embodiment of an apparatus for analyzing and synthesizing human speech according to the present invention; and FIG. 6 shows a time sequence of the apparatus for analyzing and synthesizing human speech shown in FIG. 5.

DETAILED DESCRIPTION OF THE INVENTION

Figure 1:
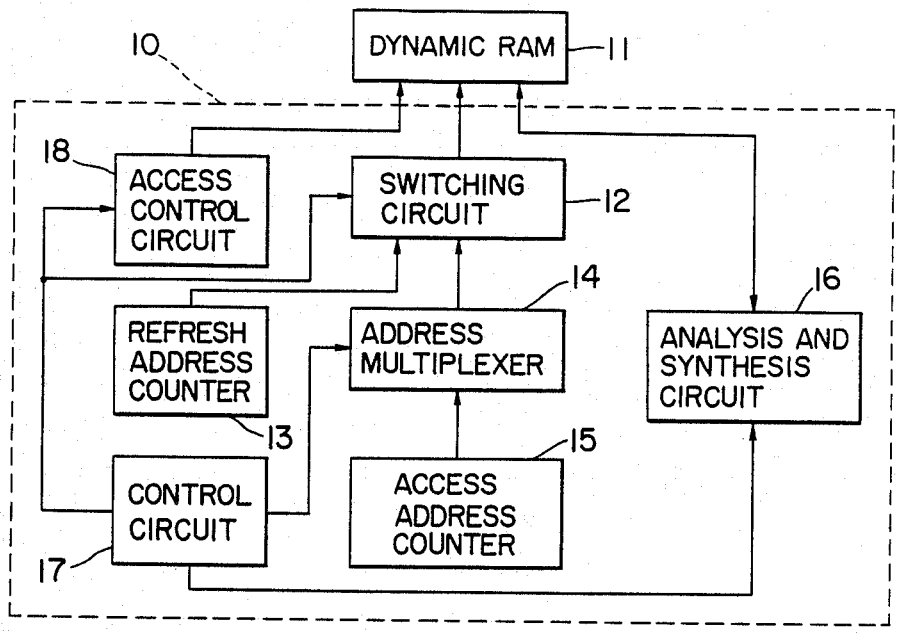
FIG. 1 is a block diagram illustrating an embodiment of an apparatus for analyzing and synthesizing human speech according to the present invention.

Referring to FIG. 1, there is shown an embodiment of an apparatus for analyzing and synthesizing human speech according to the present invention wherein the apparatus for analyzing and synthesizing human speech is designated by reference numeral 10 and will be simply called a "speech analysis and synthesis device", hereinafter. A dynamic RAM 11 connected to the speech analysis and synthesis device 10 is provided for memorizing analyzed data of human speech. For instance, the dynamic RAM 11 has capacity of 64K words. Human speech is analyzed by an analysis and synthesis circuit 16 provided in the speech analysis and synthesis device 10. The analyzed data is memorized into the dynamic RAM 11. A refresh address counter 13 is provided for producing a refresh address of the dynamic RAM 11 to count up every constant time period, i.e., refresh cycle. The refresh address counter 13 is required to have a bit configuration of 7 bits with respect to the dynamic RAM 11 of 64K words. An access address counter 15 is operative to provide an address required for an access of the analyzed data of human speech to the dynamic RAM 11 by the analysis and synthesis circuit 16. The access address counter 15 is required to have a bit configuration of 16 bits with respect to the dynamic RAM 11 of 64K words. The access address counter 15 is connected to an address multiplexer 14 which divides an address of 16 bits into high-order 8 bits and low-order 8 bits to output the high-order 8 bits and the low-order 8 bits sequentially. The address multiplexer 14 and the refresh address counter 13 are connected to a switching circuit 12. The switching circuit 12 is operative to selectively switch an output from the address multiplexer 14 and an output from the refresh address counter 13 to produce an output indicative of an address to the dynamic RAM 11.

An access control circuit 18 effects a control to determine as to whether the speech analysis and synthesis device 10 effects a refresh operation or effects an access operation to the dynamic RAM 11. Namely, when the speech analysis and synthesis device 10 carries out a refresh operation, the access control circuit 18 is operative to output a $\overline{RAS}$ signal. On the other hand, when the speech analysis and synthesis device 10 carries out an access operation, the access control circuit 18 is operative to output $\overline{CAS}$ and $\overline{CAS}$ signals. A control circuit 17 effects a control of the switching circuit 12, the address multiplexer 14, the analysis and synthesis circuit 16 and the access control circuit 18.

The counting cycle for which the refresh address counter 13, i.e. the refresh cycle, is determined by standardized characteristics of the dynamic RAM 11. In accordance with present standardized characteristics, a dynamic RAM 11 of 64K words requires 128 refresh addresses within 2 msec. Accordingly, it is sufficient that the refresh frequency of the refresh address counter 13 is above $128 \times 500 = 64000$ Hz, in other words, the refresh cycle of the refresh address counter 13 is below 15.6 nsec. The time required for refreshing and data access of the dynamic RAM 11 is about 200 nsec., which is extremely short as compared to the refresh cycle of 15.6 μsec., thus making it possible to access analyzed data during a time period subsequent to refresh operation within the refresh period.

Figure 2:
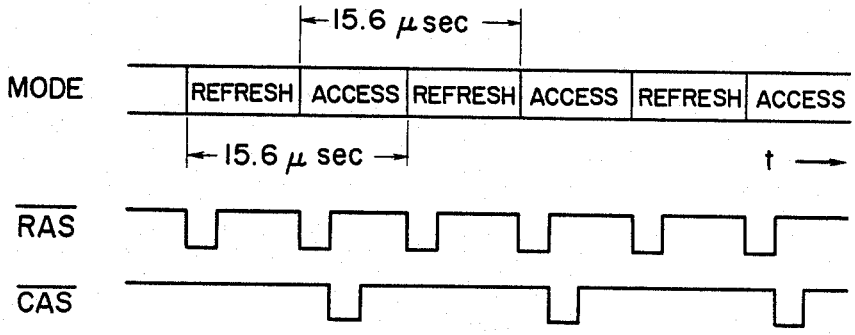
FIG. 2 and FIG. 3 show time sequences of the apparatus for analyzing and synthesizing human speech shown in FIG. 1, respectively.

The operation of the speech analysis and synthesis of this embodiment will now be described with reference to FIG. 2. The refresh address counter 13 is operative to count in synchronism with a refresh frequency of 64 KHz. The, switching circuit 12 becomes operative in synchronism with the above-mentioned refresh frequency to supply an address of the refresh address counter 13 to the dynamic RAM 11 at the first half of the refresh cycle of 15.6 μsec. as shown in FIG. 2. The access control circuit 18 also becomes operative in synchronism with the refresh frequency to output a $\overline{RAS}$ signal to the dynamic RAM 11 at the first half of the refresh cycle to effect a refresh operation. On the other hand, at the latter half of the refresh cycle, the switching circuit 12 becomes operative to supply an address outputted from the address multiplexer 14 to the dynamic RAM 11, and the address multiplexer 14 becomes operative to sequentially output an access address divided into low-order 8 bits and high-order 8 bits to the address multiplexer 14. The access control circuit 18 becomes operative to output $\overline{RAS}$ and $\overline{CAS}$ signals to the dynamic RAM 11 at the latter half of the refresh cycle, thus providing data access to the dynamic RAM 11. The analysis and synthesis circuit 16 effects write or read operation of the analytical data in accordance with the access address. Execution of such an operation allows the bit rate of the analyzed data of human speech to be 64K bit/sec.

Figure 3:
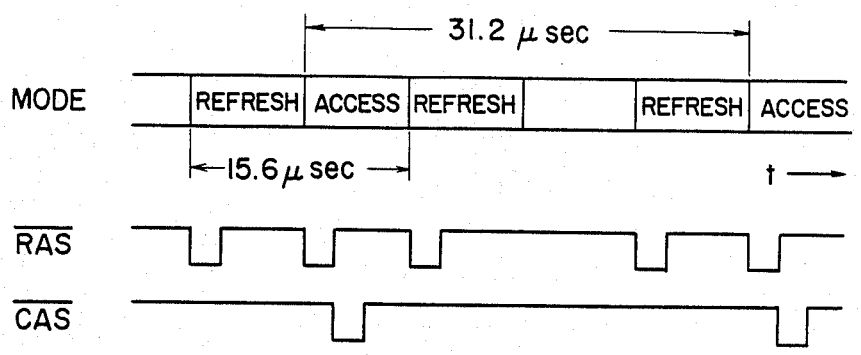

In case where analysis and synthesis is carried out with a bit rate lower than the above bit rate, data access is provided every other refresh cycle as shown in FIG. 3, making it possible to realize an operation with a bit rate of 32K bit/sec. In addition, when data access is provided every second or third refresh cycle, analysis and synthesis can be performed with a bit rate of a reciprocal of an integer e.g. $\frac{1}{3}$ or $\frac{1}{4}$, etc. of 64K bit/sec. In contrast, when analysis and synthesis is performed with a bit rate greater than 64K bit/sec., it is sufficient to increase the refresh frequency.

In accordance with this embodiment, an access of analyzed data is provided in synchronism with refresh cycle, thus enabling connection of a dynamic RAM without provision of complicated peripheral circuits.

Figure 4:
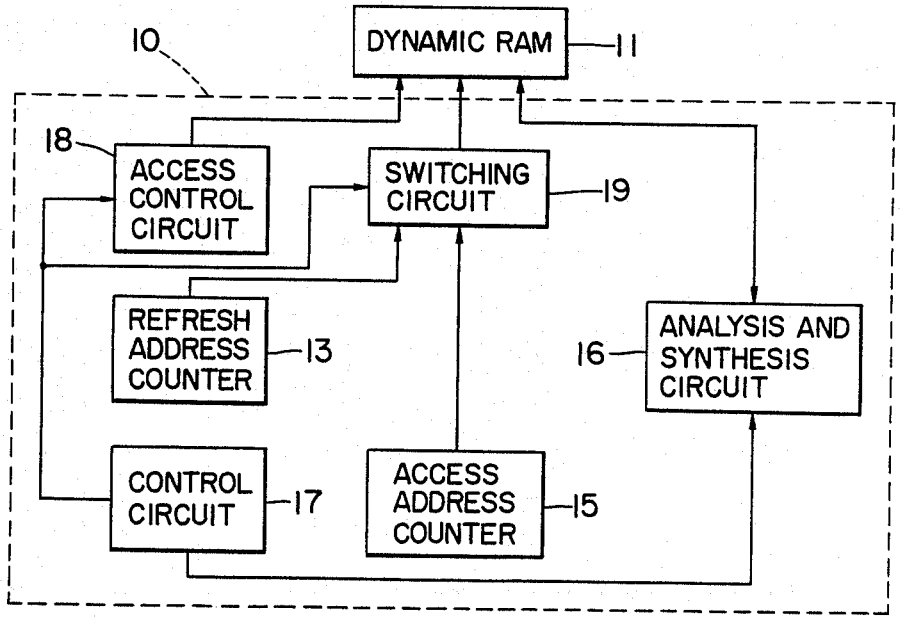
FIG. 4 is a block diagram illustrating another embodiment of an apparatus for analyzing and synthesizing human speech according to the present invention.

Referring to FIG. 4, there is shown another embodiment of a speech analysis and synthesis device according to the present invention. This embodiment is characterized in that the switching circuit 12 and the multiplexer 14 are incorporated with each other to provide a switching circuit 19. To the switching circuit 19, a refresh address from the refresh address counter 13 and an access address from the access address counter 15 are inputted. The switching circuit 19 is operative to select one among the refresh address, high-order bits of the access address and low-order bits of the access address to output a bit train thus selected as address signal to the dynamic RAM 11.

Referring to FIG. 5, there is shown a further embodiment of a speech analysis and synthesis device according to the present invention.

The speech analysis and synthesis device in this embodiment has a circuit construction similar to that shown in FIG. 1, but differs from the latter in that modification of bit configuration is applied to the refresh address counter 13, the address multiplexer 14, and the access address counter 15, thus enabling connection of dynamic RAMs of different memory capacity. Reference is made to the case where a dynamic RAM of 64K words and a dynamic RAM of 256K words are selectively connected to the speech analysis and synthesis device 10. The speech analysis and synthesis device 10 is provided with address output $A_0, \ldots,$ and $A_8$ of 9 bits as shown in FIG. 5. Initially, when connecting a dynamic RAM 11 of 64K words to the speech analysis and synthesis device 10, as shown in FIG. 5*a*, address outputs $A_0, \ldots,$ and $A_7$ of low-order 8 bits are connected to address inputs $A_0, \ldots,$ and $A_7$ of the dynamic RAM 11. In conformity with address outputs $A_0, \ldots, A_8$ of 9 bits, there are provided the refresh address counter 13 of 8 bits and the access address counter 15 of 18 bits. On the other hand, as shown in FIG. 6*a*, only low-order 7 bits of the refresh address counter 13 are provided with respect to the dynamic RAM 11 of 64K words. The operation of the access address counter 15 is performed using low-order 16 bits. The access address counter 15 is operative to sequentially output two 8 bit trains obtained by dividing 16 bits through the address multiplexer 14.

On the other hand, when connecting the dynamic RAM of 256K words to the speech analysis and synthesis device 10, as shown in FIG. 5*b*, address outputs $A_0, \ldots,$ and $A_8$ of 9 bits are connected to address inputs $A_0, \ldots,$ and $A_8$ of the dynamic RAM 11. Further, the refresh address counter 13 provides full 8 bits to the dynamic RAM 11 of 256K words as shown in FIG. 6*b*. The operation of the access address counter 15 is performed using full 18 bits. The address counter is operative to sequentially output two 9 bit trains obtained by dividing 18 bits through the address multiplexer 14.

In regard to the refresh operation, the dynamic RAM of 64K words requires effecting 128 refresh operations within 2 msec., and the dynamic RAM of 256K words requires effecting 256 refresh operations within 4 msec. Accordingly, this embodiment makes it possible to effect refresh operation of the dynamic RAM 11 in accordance with the same timing, respectively, regardless of the fact that the capacity of the dynamic RAM 11 is 64K words or 256k words.

In accordance with this embodiment, an operation is only conducted to select either the address multiplexer 14 or the switching circuit 19 in response to a 64K/256K select signal externally supplied, thus making it possible to connect either the dynamic RAM of 64 words or the dynamic RAM of 256k words to the speech analysis and synthesis device.

In the above-mentioned embodiment, it has been described that the dynamic RAM of 64K words and the dynamic RAM of 256k words are selectively connected to the speech analysis and synthesis device. However, the present invention is not limited to the above embodiment. The present invention may be realized in the same manner even in the case of other capacity of the dynamic RAM, for example, in the case where a dynamic RAM of 1 M (mega) words and a dynamic RAM of 4 M words are selectively connected to the speech analysis and synthesis device. Moreover, according to the invention, the number of the dynamic RAMs which have capacities different from each other and which can be selectively connected may be more than two.

What is claimed is:

1. An apparatus for recording and reproducing human speech by analyzing and synthesizing the same comprising:

first means for analyzing human speech according to a first control signal, providing analyzed data and synthesizing human speech on the basis of said analyzed data;

a dynamic RAM for memorizing said analyzed data provided by said first means and for reading the analyzed data therefrom;

a refresh address counter for providing a refresh signal of a predetermined frequency so as to output a refresh address sequentially varying every predetermined refresh cycle, said refresh address indicating a location of a memory cell to be refreshed in said dynamic RAM;

an access address counter for outputting an access address indicative of a location of a memory cell where said analyzed data in said dynamic RAM is accessed;

an address multiplexer for dividing said access address from said access counter into a plurality of bit trains according to a second control signal so as to obtain a upper bit train and a lower bit train, the dividing point of said bit trains being arbitrarily changeable, depending upon the memory capacity of said dynamic RAM;

second means for selecting either said refresh address or said access address in synchronism with said predetermined refresh cycle according to a third control signal;

third means for outputting a refresh control signal to said dynamic RAM when said refresh address is selected by said selecting means and for outputting an access control signal to said dynamic RAM when said access address is selected by said selecting means; and means for effecting a refresh operation of a memory cell assigned to said refresh address in response to said refresh control signal, for effecting an access to a memory cell assigned to said access address in response to said access control signal and for providing the first to third control signals to said first to third means and said address multiplexer.

2. An apparatus according to claim 1, wherein the frequency of said predetermined refresh cycle is equal to or a multiple of a frequency of a cycle at which said analyzing and synthesizing means analyzes and synthesizes human speech.

* * * * *